United States Patent [19]

Dillehay

[11] 3,986,907

[45] Oct. 19, 1976

[54] ILLUMINATING FLARE COMPOSITION CONTAINING TETRANITROCARBAZOLE

[75] Inventor: David R. Dillehay, Marshall, Tex.

[73] Assignee: Thiokol Corporation, Newtown, Pa.

[22] Filed: Mar. 7, 1975

[21] Appl. No.: 556,218

[52] U.S. Cl. ..... 149/19.6; 149/19.4; 149/19.5; 149/19.1; 149/19.9; 149/20; 149/45

[51] Int. Cl.[2] ..... C06B 45/10

[58] Field of Search ..... 149/19.1, 19.6, 45, 149/20, 19.4, 19.5, 19.9

[56] References Cited

UNITED STATES PATENTS

| | | | |
|---|---|---|---|
| 3,497,404 | 2/1970 | Hiltz | 149/45 X |
| 3,520,742 | 7/1970 | Witz | 149/19.1 X |
| 3,605,624 | 9/1971 | Dinsdale et al. | 149/19.5 X |
| 3,650,856 | 3/1972 | Artz | 149/19.6 X |
| 3,673,014 | 6/1972 | Lane et al. | 149/19.6 |
| 3,720,553 | 3/1973 | Henderson | 149/19.6 |
| 3,728,172 | 4/1973 | Dillehay et al. | 49/19.5 |
| 3,752,703 | 8/1973 | Toy et al. | 149/19.1 |

*Primary Examiner*—Edward A. Miller

[57] ABSTRACT

The burning rate of an illuminant composition adapted to be used in an illuminating flare and comprising magnesium granules, an inorganic oxidizer and an organic polymeric binder is increased by incorporating therein 0.1 to 5% by weight of tetranitrocarbazole as a burning rate modifier. The incorporation of the tetranitrocarbazole burning rate modifier permits the attainment of a given light intensity with a lesser proportion of magnesium in the composition.

6 Claims, 2 Drawing Figures

ILLUMINATING FLARE COMPOSITION CONTAINING TETRANITROCARBAZOLE

This invention relates to illuminant compositions adapted to be used in illuminating flares.

Illuminant compositions used in illuminating flares commonly comprise magnesium granules, a finely divided inorganic oxidizer, and an organic polymeric binder. Heretofore the burning rates of such compositions have been controlled by adjusting the proportion of magnesium in the composition, varying the particle size of the magnesium granules and/or adjusting the amount of binder in the composition. Thus the burning rate can be increased by increasing the quantity of magnesium in the composition or decreasing its particle size or reducing the amount of polymeric binder in the composition.

However, such methods of adjusting the burning rate leave something to be desired. Thus increasing the amount of magnesium or using a smaller particle size increases the cost of the composition. Also the extent to which the burning rate can be varied by adjusting the proportions of the magnesium or binder is rather limited. For example, physical properties requirements prevent lowering of the polymeric binder content below about 4.5% by weight. In addition, adjustment of the proportions of the composition to vary the burning rate may in some cases adversely affect the candlepower of the illuminant.

It is accordingly an object of the present invention to provide an illuminant composition containing a novel burning rate modifier or catalyst for increasing the burning rate of the composition. It is another object of the invention to provide a burning rate catalyst which, when incorporated in a magnesium-containing illuminant flare composition, increases the burning rate thereof and also the intensity of the light emitted by the flare. It is still another object of the invention to provide an illuminating flare composition incorporating a burning rate catalyst which permits a given light intensity to be achieved with a lesser amount of magnesium, thereby reducing the cost of the composition. Other objects of the invention will be in part obvious and in part pointed out hereafter.

The present invention is largely based on applicant's finding that tetranitrocarbazole is an effective burning rate catalyst in illuminant compositions of the general type referred to above and when incorporated in a small amount in such compositions substantially increases the burning rate of the cmposition, as well as the intensity of the light emitted during burning of the illuminant. Since illuminant flares are commonly required to meet a certain minimum light intensity specification, the burning rate catalyst of the present invention can be advantageously used to reduce the quantity of magnesium required in a given flare composition to meet such a minimum light intensity specification, thereby reducing the cost of the flare. The amount of tetranitrocarbazole incorporated in the composition may vary from say 0.1 to 5% by weight with the preferred range being 0.5% to 2.0% by weight.

Figure 1:
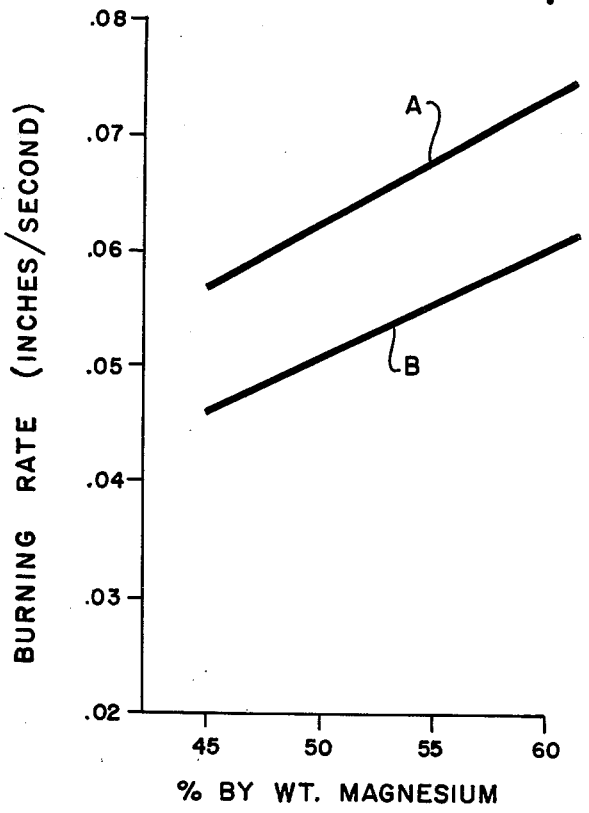
Figure 2:
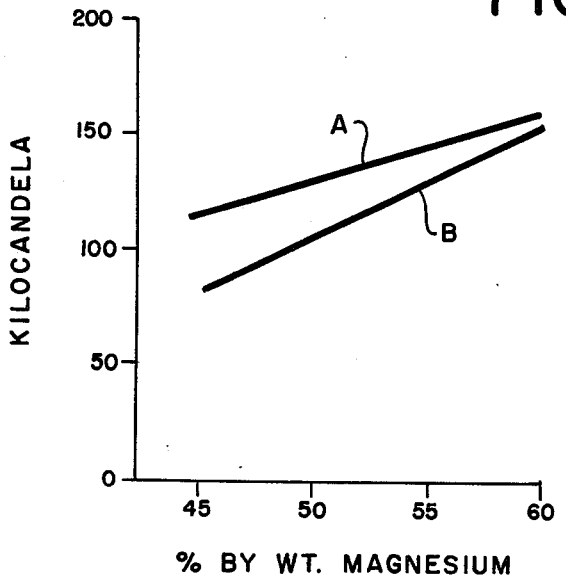

The effectiveness of tetranitrocarbazole as a burning rate modifier is illustrated by the graphs of the accompanying drawing. Referring to the drawing, FIG. 1 is a plot of percent by weight of magnesium against the burning rate of various illuminant compositions, and FIG. 2 is a plot of percent by weight of magnesium against light intensity in kilocandela for a series of compositions. In each Figure of the drawing, Curve A is based on data for an illuminant composition containing 1% of tetranitrocarbazole, whereas Curve B is based on data for a similar composition containing no tetranitrocarbazole. The compositions on which the curves are based are further identified below.

In general, any of the inorganic oxidizers and polymeric binders known to be useful in magnesium-containing illuminant flare compositions can be used in the present compositions. The preferred oxidizer is sodium nitrate, but sodium nitrite, sodium chlorate and sodium perchlorate can be used, as well as the chlorates, perchlorates and nitrates of the other alkali metals. The oxidizer may be used to the extent of say 30% to 65% by weight of the composition with 45% to 55% being preferred.

The preferred polymeric binders for use in the present compositions are liquid polymers that are curable to solid elastomers. Especially good results have been obtained using a liquid polythiopolymercaptan polymer made generally in accordance with the procedure disclosed in U.S. Pat. No. 2,466,963. In the illustrative examples given below, an Lp-33 liquid polysulfide polymer is used. The LP-33 polymer has the recurring structure ($S.CH_2.CH_2OCH_2.OCH_2.CH_2S$), mercapto terminals, a molecular weight of the order of 1,000 and about 0.5% of cross-linking. Such liquid polymers can be cured, for example, with polyepoxides, e.g., the diglycidyl ether of bis-phenol A, the triglycidyl ether of trimethylolpropane or the reaction product of glycerol and epichlorhydrin.

Other types of liquid curable polymeric binders that may be used are the carboxyl-terminated polyesters, such as disclosed, for example, in U.S. Pat. No. 3,605,624; carboxylterminated polybutadienes such as disclosed in U.S. PAT. No. 3,235,589; and copolymers of butadiene or isoprene with acrylic acid disclosed, for example, in U.S. Pat. No. 3,653,966, all of which can be cured with polyepoxides of the type referred to above. Liquid polyurethane prepolymers which are isocyanateterminated and which are curable with polyols in known manner can also be used. The quantity of binder may vary from say 4% to 10% by weight of the composition with the preferred range being 5% to 8% by weight.

The magnesium used in the present compositions can be of a type commonly used in illuminating flares. Good results have been obtained by using granules having a weight mean diameter of 350 to 450 microns. The quantity of magnesium may vary from say 35% to 70% by weight of the composition with the preferred range being 45% to 55%.

In order to point out more fully the nature of the present invention, there is described below the exemplary preparation of the series of compositions embodying the present invention. Certain test data obtained by testing such compositions are tabulated in Table I. The compositions of Table I were prepared by mixing 6% of a curable organic polymeric binder and varying amounts of magnesium as set forth in the Table, with the remainder of the composition in each case being sodium nitrate and 1% by weight of tetranitrocarbazole. The binder comprised 50% by weight of the diglycidyl ether of bis-phenol A, 45% of LP-33 liquid polysulfide polymer and 5% of dimethylaminomethyl phenol. The tetranitrocarbazole used is sold under the trade designation PAPD 639 and comprises mostly the 1,3,6,8-isomer with about 10% being the 1,2,6,8-isomer. After mixing the composition was cured in the usual manner to convert the liquid polymer to an elastomer.

As indicated in Table I, four test compositions were prepared and tested to determine their linear burning rate in inches per second, their light intensity in kilocandela and their light-generating efficiency in kilocandela - seconds per gram of mix with the results given in the Table.

Table I

| % by Wt. Mg. | Burning Rate | Light Intensity | Light generating Efficiency |
|---|---|---|---|
| 45 | .060 | 105.7 | 48.4 |
| 50 | .060 | 117.2 | 54.6 |
| 55 | .068 | 135.0 | 56.1 |
| 60 | .075 | 146.9 | 56.5 |

Referring again to the drawing, Curve A of FIG. 1 is a plot of the relationship between percent by weight magnesium in the composition and the burning rate of the composition based on the data of Table I. Curve B of FIG. 1 is a corresponding plot of data for compositions which are the same as those of Table I, except that the tetranitrocarbazole was omitted.

Curve A of FIG. 2 is a plot of percent by weight magnesium against light intensity in kilocancela based on the data of Table I. Curve B of FIG. 2 is a similar plot based on data obtained with compositions containing no tetranitrocarbazole, but otherwise the same as the compositions for which data are given in Table I.

From a comparison of Curves A and B in FIG. 1, it is evident that the addition of only 1% of tetranitrocarbazole to the magnesium-containing illuminant resulted in a substantial increase in burning rate. A comparison of Curves A and B of FIG. 2 shows that a significant increase in light intensity was obtained by incorporating 1% of tetranitrocarbazole in the composition, particularly in those compositions containing from 45% to 52% by weight of magnesium. Thus the data show that by using tetranitrocarbazole as a burning rate modifier, a given light intensity can be achieved with a lesser amount of magnesium.

It is, of course, to be understood that the foregoing description is intended to be illustrative only, and that numerous changes can be made in the ingredients, proportions and conditions disclosed without departing from the spirit of the invention as defined in the appended claims.

I claim:

1. In an illuminant composition comprising magnesium powder, a finely divided inorganic oxidizer, and an organic binder, the improvement which comprises a small amount of tetranitrocarbazole in said composition as a burning rate modifier.

2. A composition according to claim 1 wherein said tetranitrocarbazole is present to the extent of 0.1 to 5% by weight.

3. An illuminant composition consisting essentially of 35 to 70% by weight magnesium, 30 to 65% inorganic oxidizer selected from the group consisting of sodium nitrite and alkali metal chlorates, perchlorates and nitrates, 4 to 10% of organic binder and 0.1 to 5% of tetranitrocarbazole.

4. An illuminant composition according to claim 3 wherein the oxidizer is sodium nitrate.

5. An illuminant composition according to claim 3 wherein the oxidizer is sodium nitrite.

6. An illuminant composition according to claim 3 wherein the binder is a reaction product of mercaptan-terminated liquid polysulfide polymer and a polyepoxide.

* * * * *